US012000026B2

(12) United States Patent
Hosokawa et al.

(10) Patent No.: US 12,000,026 B2
(45) Date of Patent: Jun. 4, 2024

(54) ALUMINUM ALLOY SHEET FOR AUTOMOTIVE STRUCTURAL MEMBER, AUTOMOTIVE STRUCTURAL MEMBER, AND METHOD FOR MANUFACTURING ALUMINUM ALLOY SHEET FOR AUTOMOTIVE STRUCTURAL MEMBER

(71) Applicant: Kobe Steel, Ltd., Kobe (JP)

(72) Inventors: Tomoki Hosokawa, Moka (JP); Takahiko Nakamura, Moka (JP)

(73) Assignee: Kobe Steel, Ltd., Kobe (JP)

( * ) Notice: Subject to any disclaimer, the term of this patent is extended or adjusted under 35 U.S.C. 154(b) by 104 days.

(21) Appl. No.: 17/102,665

(22) Filed: Nov. 24, 2020

(65) Prior Publication Data

US 2021/0180160 A1 Jun. 17, 2021

(30) Foreign Application Priority Data

Dec. 13, 2019 (JP) ..... 2019-225446

(51) Int. Cl.
*C22C 21/02* (2006.01)
*C21D 8/02* (2006.01)

(52) U.S. Cl.
CPC ..... *C22C 21/02* (2013.01); *C21D 8/0226* (2013.01); *C21D 8/0236* (2013.01); *C21D 8/0247* (2013.01)

(58) Field of Classification Search
CPC ..... C22C 21/02; C22C 21/08; C22C 21/14; C22C 21/16; C22C 21/04; C22F 1/043; C22F 1/047; C22F 1/057
USPC ..... 420/534
See application file for complete search history.

(56) References Cited

U.S. PATENT DOCUMENTS 5,888,320 A * 3/1999 Dorward ..... C22C 21/02 148/693
2016/0047021 A1* 2/2016 Nakamura ..... C22C 21/08 420/544
2017/0121801 A1 5/2017 Hashimoto et al.

FOREIGN PATENT DOCUMENTS

JP 2001-294965 A 10/2001
JP 2007-254825 A 10/2007
JP 2017-88906 A 5/2017

OTHER PUBLICATIONS

English Abstract and English Machine Translation of Yasunaga et al. (JP 2007-254825) (Oct. 4, 2007).*

* cited by examiner

*Primary Examiner* — Jessee R Roe
(74) *Attorney, Agent, or Firm* — Oblon, McClelland, Maier & Neustadt, L.L.P.

(57) ABSTRACT

Provided are an aluminum alloy sheet for automotive structural member which is excellent and well-balanced in strength, formability, and crushability, an automotive structural member, and a method for manufacturing an aluminum alloy sheet for automotive structural member. An aluminum alloy sheet for automotive structural member is an Al—Mg—Si-based aluminum alloy sheet containing, in mass %, Mg: 0.4% or more and 1.0% or less, Si: 0.6% or more and 1.2% or less, and Cu: 0.6% or more and 1.3% or less with the remainder being Al and inevitable impurities and having an earing ratio of −13.0% or less.

9 Claims, 3 Drawing Sheets

ALUMINUM ALLOY SHEET FOR AUTOMOTIVE STRUCTURAL MEMBER, AUTOMOTIVE STRUCTURAL MEMBER, AND METHOD FOR MANUFACTURING ALUMINUM ALLOY SHEET FOR AUTOMOTIVE STRUCTURAL MEMBER

TECHNICAL FIELD

The present invention relates to an Al—Mg—Si-based (6xxx-series) aluminum alloy sheet manufactured by normal rolling, and particular to an aluminum alloy sheet for automotive structural member having an excellent crushability.

The aluminum alloy sheet mentioned in the present invention is a rolled sheet subjected to hot rolling or cold rolling, which is a raw-material aluminum alloy sheet after being subjected to tempering such as solution treatment or quenching treatment and before being formed into an automotive structural member to be used and subjected to artificial aging treatment such as paint baking hardening treatment. In the following description, aluminum is referred to also as "Al".

BACKGROUND ART

In recent years, out of consideration to a global environment or the like, there has been an ever-growing social demand for reductions in weights of automotive bodies. To meet such a demand, to such portions of the automotive bodies as panels (outer panels such as a hood, a door, and a roof and inner panels) and reinforcing members such as a bumper reinforce (bumper R/F) and a door beam, aluminum alloy materials are applied instead of existing steel materials such as steel sheets.

For further reductions in the weights of the automotive bodies, it is required to apply the aluminum alloy materials even to automotive structural members such as members such as side members, frames, and pillars which particularly contribute to weight reductions among automotive members. For the purpose of occupant safety, it is required to use, for such automotive structural members, the aluminum alloy materials excellent in shock absorption and crushability (crush resistance or crushing characteristic) at the time of an automotive body collision, while allowing a raw material sheet to retain the same strength and formability as those of the automotive panel members mentioned above.

Examples of a test for measuring the crushability mentioned above include "VDA238-100 Plate bending test for metallic materials" (hereinafter referred to as the "VDA bending test") standardized by the German Automobile Industry Association (VDA). In recent years, in European countries and the like, to keep up with higher levels of (tougher) safety standards for automotive collisions, evaluation based on the VDA bending test has been performed, and automotive structural members such as frames and pillars having more excellent crushing characteristics are in demand.

As a means for improving a crushability of a 6xxx-series aluminum alloy for automotive structural member, a method which controls sizes and forms of crystal grains as well as an area ratio of Cube orientation has conventionally been known. For example, a 6xxx-series aluminum alloy sheet is disclosed in which grain sizes of crystal grains in a sheet thickness direction are defined, and a ratio between grain diameters in the sheet thickness direction and grain diameters in a rolling direction is controlled (see Japanese Unexamined Patent Application Publication No. 2001-294965).

Meanwhile, a 6xxx-series aluminum alloy sheet is also proposed in which amounts of Mg, Si, and Cu added thereto are adjusted, and an average area ratio of the Cube orientation in a sheet cross section is controlled to be 22% or more (see Japanese Unexamined Patent Application Publication No. 2017-88906). Note that, in Japanese Unexamined Patent Application Publication No. 2017-88906 described above which is intended to improve the crushability, it is stated that the foregoing VDA bending test performed as an evaluation test for the crushability of the sheet is correlated with the crushability at the time of an automotive collision. A bending angle obtained by the VDA bending test allows whether or not the crushability is excellent to be quantitatively evaluated.

SUMMARY OF THE INVENTION

However, the strength and the crushability have a trade-off relationship therebetween. When the strength is increased by adjusting contents in an aluminum alloy, a problem of a degraded crushability occurs. As described above, safety standards for automobiles or the like have been increasingly toughened year by year, and aluminum alloy sheets having such characteristics as to further enhance safety are in demand.

In addition, in an automotive field, design diversification has also been pursued in recent years, and more shape-flexible materials are in demand in consideration of extended use thereof to difficult-to-form portions. Not only the foregoing strength and crushability are required, but also excellent formability into automotive structural members is required. As a result, it is expected to develop an aluminum alloy sheet which is excellent and well-balanced in the strength, formability, and crushability of a raw material sheet.

In view of such circumstances, it is therefore an object of the present invention to provide a 6xxx-series aluminum alloy sheet to be manufactured by normal rolling, which is an aluminum alloy sheet for automotive structural member having a raw material sheet excellent and well-balanced in strength, formability, and crushability, an automotive structural member, and a method for manufacturing an aluminum alloy sheet for automotive structural member.

To solve the problem described above, the present inventors have conducted constant study and consequently found that, by appropriately adjusting a chemical composition of an aluminum alloy and also defining anisotropy of a texture of the aluminum alloy through use of an earing ratio to limit a value thereof to a predetermined range, it is possible to obtain an aluminum alloy sheet which is excellent and well-balanced in strength, formability, and crushability.

Specifically, an aluminum alloy sheet for automotive structural member according to the present invention is an Al—Mg—Si-based aluminum alloy sheet containing, in mass %, Mg: 0.4% or more and 1.0% or less, Si: 0.6% or more and 1.2% or less, and Cu: 0.6% or more and 1.3% or less with the remainder being Al and inevitable impurities, wherein an earing ratio is −13.0% or less.

The aluminum alloy sheet for automotive structural member according to an embodiment of the present invention further contains, in mass %, at least one selected from the group consisting of Mn: 1.0% or less, Fe: 0.5% or less, Cr: 0.3% or less, Zr: 0.2% or less, V: 0.2% or less, Ti: 0.1% or less, Zn: 0.5% or less, Ag: 0.1% or less, and Sn: 0.15% or less.

In an aluminum alloy sheet for automotive structural member according to a preferred embodiment of the present invention, the content of Mg in mass % is 0.4% or more and 0.6% or less.

In an aluminum alloy sheet for automotive structural member according to another preferred embodiment of the present invention, the content of Si in mass % is 0.6% or more and 0.8% or less.

In an aluminum alloy sheet for automotive structural member according to still another preferred embodiment of the present invention, the aluminum alloy sheet for automotive structural member has such a bake hard property that, after 20-minute artificial aging treatment is performed at 180° C., a 0.2% proof stress is 250 MPa or more.

An automotive structural member according to the present invention uses any one of the aluminum alloy sheets for automotive structural member described above.

A method for manufacturing an aluminum alloy sheet for automotive structural member according to the present invention is a method for manufacturing an Al—Mg—Si-based aluminum alloy sheet, the method including the steps of casting an aluminum alloy containing, in mass %, Mg: 0.4% or more and 1.0% or less, Si: 0.6% or more and 1.2% or less, and Cu: 0.6% or more and 1.3% or less with the remainder being Al and inevitable impurities; performing homogenization heat treatment; performing hot rolling; performing cold rolling; performing annealing; performing solution treatment; and performing quenching, wherein a rolling ratio in the step of performing the cold rolling is controlled to be 20% or less, and a heat treatment temperature in the step of performing the annealing is set to be 275° C. or more.

In the method for manufacturing an aluminum alloy sheet for automotive structural member according to the present embodiment, the aluminum alloy further contains, in mass %, at least one selected from the group consisting of Mn: 1.0% or less, Fe: 0.5% or less, Cr: 0.3% or less, Zr: 0.2% or less, V: 0.2% or less, Ti: 0.1% or less, Zn: 0.5% or less, Ag: 0.1% or less, and Sn: 0.15% or less.

According to the present invention, by appropriately adjusting a chemical composition of an aluminum alloy and also allowing a texture of the aluminum alloy to have anisotropy, it is possible to provide an aluminum alloy sheet for automotive structural member which is excellent and well-balanced in strength, formability, and crushability.

In addition, by adjusting the chemical composition of the aluminum alloy and also adjusting a cold rolling ratio and a heat treatment temperature during annealing in manufacturing steps therefor, it is possible to manufacture an aluminum alloy sheet for automotive structural member which is excellent in strength, formability, and crushability as well as an automotive structural member using the aluminum alloy sheet.

DESCRIPTION OF EMBODIMENTS

Figure 1:
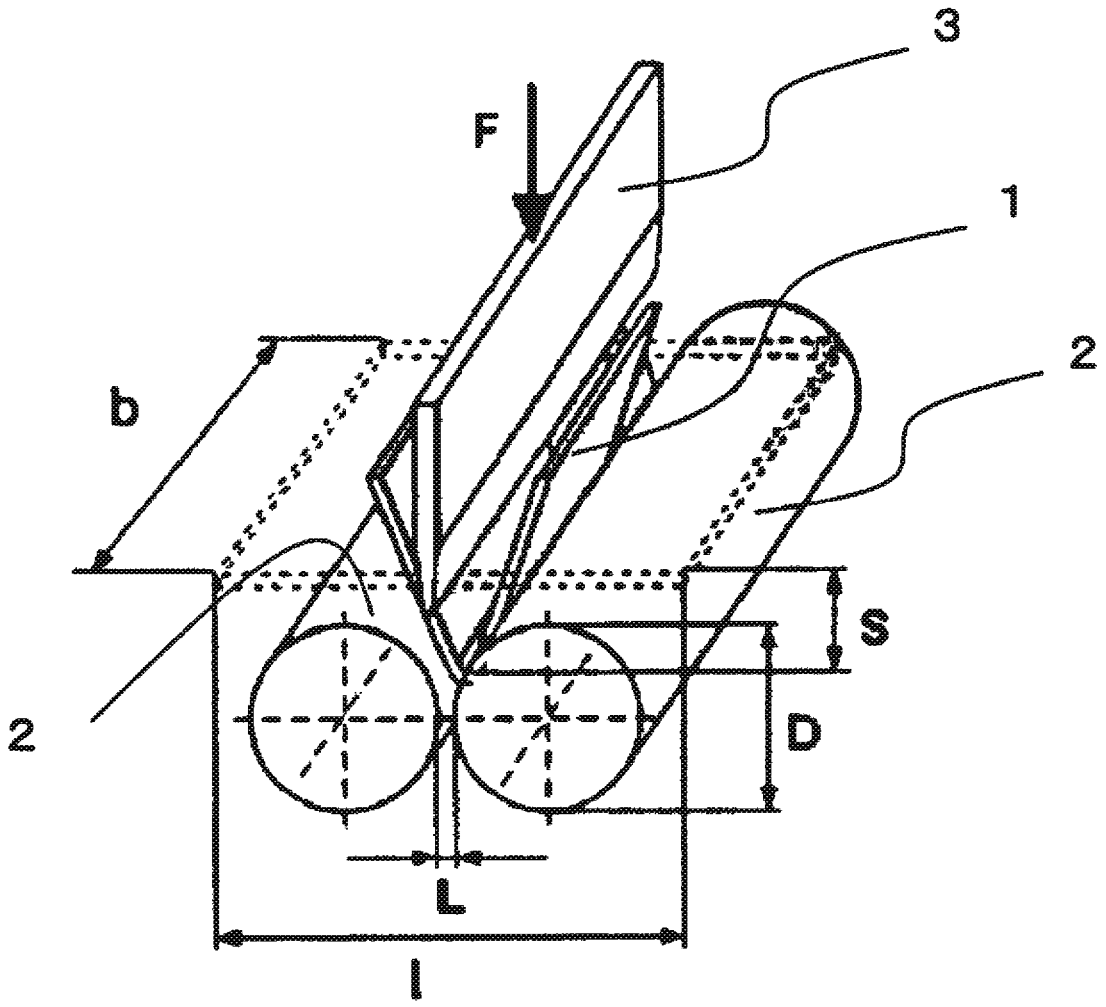
FIG. 1 is a perspective view illustrating a mode of a VDA bending test for evaluating a crushability.

A detailed description will be given below of a reason for limiting a chemical composition and an earing ratio of an aluminum alloy sheet for automotive structural member according to an embodiment (present embodiment) of the present invention and a reason for limiting numeral values in a method for manufacturing the aluminum alloy sheet for automotive structural member.

The description is based on an assumption that an Al—Mg—Si-based (hereinafter referred to also as "6xxx-series") aluminum alloy sheet of the present invention is intended to be used not for an existing automotive panel member, but for the automotive structural member described above.

Accordingly, the automotive structural member (hereinafter referred to also as the "structural member") is required to have not only the same formability as that of the existing automotive panel member mentioned above, but also an excellent crushability which is a characteristic specific to the use purpose as the automotive structural member as well as a proof stress which is high even after artificial aging. Even when any of these characteristics lacks, the structural member at which the present embodiment is aimed becomes unsatisfactory.

Consequently, the following description of requirements in the present embodiment is meant to use the aluminum alloy sheet for the structural member and satisfy each of specific required characteristics or simultaneously satisfy the specific required characteristics.

Note that, in the present embodiment, a sign "-" means being equal to or more than a lower limit value on the left side thereof and equal to or less than an upper limit value on the right side thereof (Chemical Composition of Aluminum Alloy Sheet)

To satisfy characteristics required of the structural member described above in terms of a chemical composition, an Al—Mg—Si-based aluminum alloy sheet according to the present embodiment contains, in mass %, Mg: 0.4% or more and 1.0% or less, Si: 0.6% or more and 1.2% or less, and Cu: 0.6% or more and 1.3% or less with the remainder being Al and inevitable impurities.

A description will be given below of the range and meaning of a content of each of elements in the Al—Mg—Si-based aluminum alloy described above or an allowable amount thereof. Note that each of percentage representations of the contents of the elements indicates mass %.

<Mg: 0.4% or More and 1.0% or Less>

During artificial aging treatment such as paint baking treatment, Mg forms, in cooperation with Si, a compound phase of $Mg_2Si$ or the like to be precipitated. Accordingly, by appropriately adjusting a content of Mg, it is possible to enhance a strength of the aluminum alloy sheet.

When the content of Mg is less than 0.4%, it is difficult to obtain a strength sufficient for the structural member.

Meanwhile, when the content of Mg exceeds 1.0%, during casting and solution quenching treatment, the compound phase of $Mg_2Si$ or the like is crystalized or precipitated into coarse grains, which serve as tiny starting points of fracture to degrade the crushability. The content of Mg mentioned above is preferably 0.8% or less, or more preferably 0.6% or less.

Note that, in the present specification, "Strength of Aluminum Alloy Sheet" can be evaluated based on 0.2% proof stresses before and after artificial aging. The 0.2% proof stress before the artificial aging refers to a measurement value (MPa) of the 0.2% proof stress of the aluminum alloy sheet (before the artificial aging) after being subjected to solution treatment and quenching treatment.

Meanwhile, the 0.2% proof stress after the artificial aging refers to a measurement value (MPa) of the 0.2% proof stress of the aluminum alloy sheet (after the artificial aging) after being subjected to 20-minute artificial hardening treatment at a temperature of 180° C.

As these 0.2% proof stresses are higher, the strength is higher, which means that the aluminum alloy sheet has an excellent bake hard property (BH property).

<Si: 0.6% or More and 1.2% or Less>

During the artificial aging such as the paint baking treatment, Si also forms, in cooperation with Mg, a compound phase of $Mg_2Si$ or the like to be precipitated. Accordingly, by appropriately adjusting a content of Si, it is possible to enhance the strength of the aluminum alloy sheet.

When the content of Si is less than 0.6%, it is difficult to obtain a strength sufficient for the structural member. The content of Si mentioned above is preferably 0.7% or more, or more preferably 0.8% or more.

Meanwhile, when the content of Si exceeds 1.2%, during the casting and the solution quenching treatment, a compound phase of $Mg_2Si$ or the like is crystallized or precipitated into coarse grains, which serve as tiny starting points of fracture to degrade the crushability. The content of Si mentioned above is preferably 1.1% or less, or more preferably 1.0% or less.

<Cu: 0.6% or More and 1.3% or Less>

When a content of Cu is less than 0.6%, it is difficult to obtain a strength sufficient for the structural member. Accordingly, the content of Cu is adjusted to be 0.6% or more, or preferably 0.7% or more.

Meanwhile, when excessive Cu is contained to have a content in excess of 1.3%, as age precipitation proceeds, a Cu precipitation free zone (referred to also as PFZ) is formed in the vicinity of a grain boundary. In a corrosive environment, the zone having an electric potential lower than that in the grains is selectively dissolved to degrade intergranular corrosion resistance (resistance to corrosion). The content of Cu is adjusted to be 1.3% or less, preferably 1.1% or less, or more preferably 0.9% or less.

<Inevitable Impurities>

The aluminum alloy sheet according to the present embodiment may contain elements other than those mentioned above as inevitable impurities depending on selection of a raw material to be melted during manufacturing of ingots. A content of each of the inevitable impurities other than the elements mentioned above is limited to a range defined for a 6xxx-series alloy by JIS standards or the like. Specific examples of the inevitable impurities include Ni, In, Ga, B, Na, Ca, and Sc. The respective contents of these elements are individually controlled to be 0.05% or less, and a total content thereof is controlled to be 0.15% or less.

<Other Elements>

The aluminum alloy sheet according to the present embodiment can further contain, as elements other than the elements mentioned above, elements shown below by way of example. These elements have respective upper-limit contents shown below as allowable amounts when these elements contained in the aluminum alloy sheet came from the molten raw material of the ingots, such as scraps. Even when positively added to the aluminum alloy sheet, these elements do not hinder the effect of the present invention as long as the contents of these elements fall within the ranges shown below. Note that each of the contents has no lower limit, and there may be a case where the content is 0%.

Mn: 1.0% or less, Fe: 0.5% or less, Cr: 0.3% or less, Zr: 0.2% or less, V: 0.2% or less, Ti: 0.1% or less, Zn: 0.5% or less, Ag: 0.1% or less, and Sn: 0.15% or less (Sheet Thickness of Aluminum Alloy: 1.5 mm or More)

A lower-limit sheet thickness of the Al—Mg—Si-based aluminum alloy sheet according to the present invention is not particularly limited. However, to allow the Al—Mg—Si-based aluminum alloy sheet to have a strength and a rigidity each required of an automotive structural member, the sheet thickness is, e.g., 1.5 mm or more. An upper-limit sheet thickness thereof is also not particularly limited but, when consideration is given to, e.g., a limit of a forming process such as press forming and to a range of a weight increase which does not impair a weight reducing effect achieved on a steel sheet as a comparative material, the upper-limit sheet thickness is, e.g., 4.0 mm or less. Whether the aluminum alloy is formed into a hot-rolled sheet or a cold-rolled sheet is selected appropriately based on the range of the sheet thickness.

(Earing Ratio: −13.0%)

An earing ratio of an aluminum alloy sheet represents anisotropy of a texture and has a particularly strong correlationship with a degree of integration of Cube orientation. When the earing ratio exceeds −13.0%, the degree of integration of the Cube orientation in the Al alloy sheet is low, and a shear band in bending deformation during crushing of the Al alloy sheet is not prevented to result in a lower crushability.

<Method for Measuring Earing Ratio>

From a specimen sheet, a disk-shaped specimen (blank) having an outer diameter of 66 mm is punched out and, using a punch having a diameter of 40 mm, cupping is performed on the specimen to produce a drawn cup having a cup diameter of 40 mm. By measuring an ear height of the drawn cup, it is possible to calculate an earing ratio (0°-90° earing ratio) (%) based on Formula (1) below.

In Formula (1) below, hX represents the ear height of the drawn cup, and a numeral X following h represents a position at which a height of the cup is measured and indicates the position at an X° angle to a direction in which the Al alloy sheet is rolled.

$$\text{Earing Ratio (\%)}=[\{h45+h135+h225+h315)-(h0+h90+h180+h270)\}/\{½(h0+h90+h180+h270+h45+h135+h225+h315)\}]\times 100 \quad (1)$$

Note that, to describe the meaning of Formula (1) above, a representation in Formula (2) below may also be used.

$$\text{Earing ratio (\%)}=\{(\text{Average Value of Heights at Four Positions in 45° Directions Based on Bottom Surface (Rolling Direction) of Cylindrical Container-Average Value of Heights at Four Positions in 0° and 90° Directions Based on Bottom Surface of Cylindrical Container}/(\text{Average Value of Heights at Eight Positions in 0°, 45°, and 90° Directions Based on Bottom Surface of Cylindrical Container})\}\times 100 \quad (2)$$

(Crushability)

The crushability is a characteristic of a structural member such that, when an impactive load resulting from a collision of an automobile is applied to the structural member, the structural member keeps deforming to the end without being cracked or crushed (or even though cracked or crushed). A member having an excellent crushability undergoes bending deformation into an accordion shape without being cracked or crushed (or even though cracked or crushed).

As described above, when the Mg content and the Si content in the aluminum alloy exceed the upper limits of the ranges according to the present embodiment, the crushability deteriorates. The crushability can be evaluated using a VDA bending test shown below, and a bending angle is preferably 95° or more, more preferably 100° or more, still more preferably 105° or more, and most preferably 110° or more.

In the present embodiment, the specimen having such a crushability that the bending angle is 95° or more is evaluated to be acceptable for the automotive structural member.

Meanwhile, when the specimen has such a crushability that the bending angle is less than 95°, the specimen is unacceptable for the automotive structural member.

A bending test for evaluating the crushability is performed in accordance with a VDA bending test according to standards established by the German Automobile Industry Association (VDA).

Figure 2A:
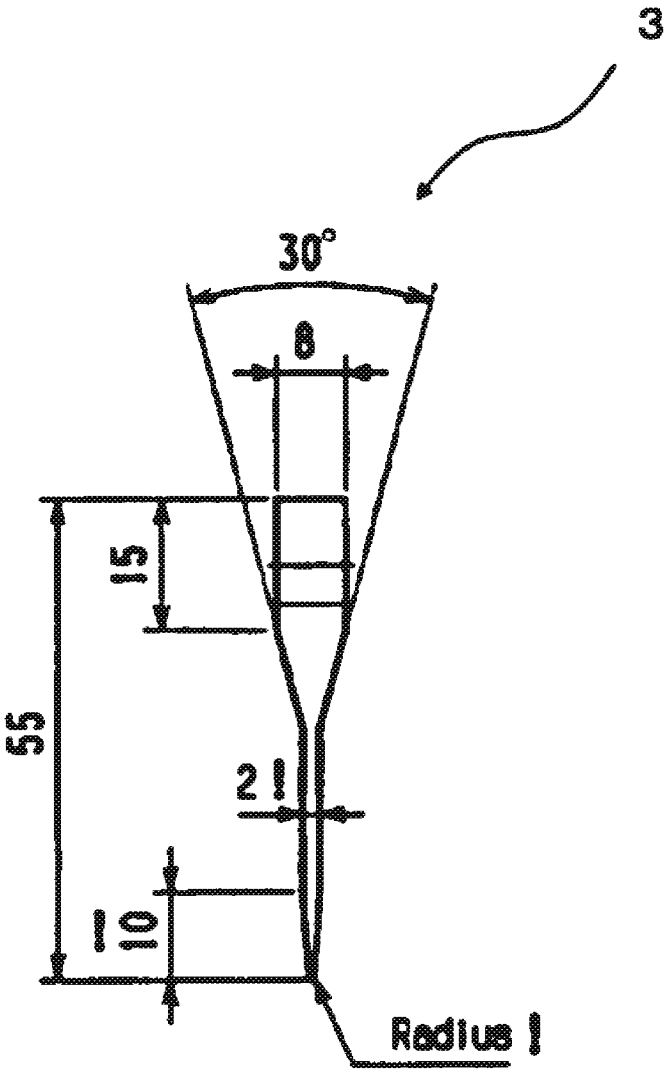
FIG. 2A is a front view of a punch in FIG. 1.
Figure 2B:
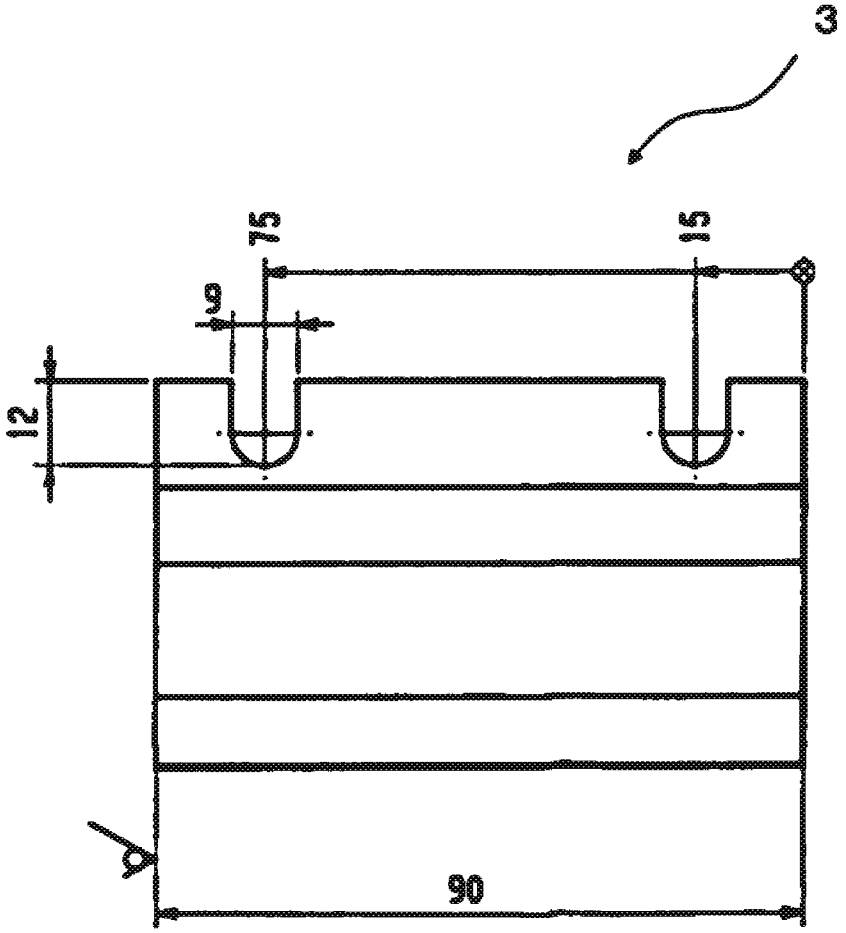
FIG. 2B is a side view of the punch in FIG. 1.

FIG. 1 is a perspective view illustrating the test method. FIGS. 2A and 2B are a front view and a side view of a punch 3 serving as a sheet-like press-bending jig.

First, a roll gap L is provided and, between two rolls 2 disposed to be parallel with each other, as indicated by a dotted line in FIG. 1, a sheet-like specimen 1 is horizontally placed to be laterally evenly located with respect to the rolls 2.

Next, above the sheet-like specimen 1, the punch 3 serving as the sheet-like press-bending jig is placed so as to be vertically upright with respect to the specimen 1. Specifically, the rolls 2, the specimen 1, and the punch 3 are placed such that a tip side of the punch 3 is located at a middle of the roll gap L and that a direction in which the sheet-like specimen 1 is rolled and a direction in which the sheet-like punch 3 extends are perpendicular to each other.

Then, the punch 3 is pressed against a middle portion of the sheet-like specimen 1 from above to apply a load F thereto to press-bend (push-bend) the sheet-like specimen 1 toward the narrow roll gap L mentioned above and press-fit the middle portion of the sheet-like specimen that has undergone bending deformation into the narrow roll gap mentioned above.

At this time, an angle outside the bent middle portion of the sheet-like specimen 1 when the downward load F from the punch 3 is maximum is measured as the bending angle (°), and the crushability is evaluated based on a magnitude of the bending angle. In other words, as the bending angle is larger, the crushability can be determined to be higher since the sheet-shape specimen is not crushed halfway and the bending deformation is sustained.

Test conditions for the VDA bending test are such that the sheet-like specimen 1 has a sheet thickness of 2.0 mm and a square shape in which a side has a length b of 60 mm and another side has a length l of 60 mm, each of the two rolls 2 has a diameter D of 30 mm, and the roll gap L is 4.0 mm corresponding to 2.0 times the sheet thickness of the sheet-like specimen 1. S represents a depth reached by the middle portion of the sheet-shaped specimen that has been press-fit into the roll gap when the load F is maximum.

Note that, as illustrated in FIG. 2B, the punch 3 has an edged tapered shape such that a side thereof to be brought into contact with the specimen 1 has a length of 90 mm and a lower end side (edged portion) to be brought into contact with the middle portion of the sheet-like specimen 1 has a radius r of 0.2 mmφ, as illustrated in the front view thereof.

On a side opposite to the edged portion of the punch 3, two recessed portions each having a width of 9 mm and a depth of 12 mm are formed. The punch 3 is configured to apply the load to the specimen 1 through engagement of the recessed portions with a load application device (not shown).

(Strength)

The aluminum alloy sheet according to the present embodiment preferably has a 0.2% proof stress (bake hard property or BH property) of 250 MPa or more after a pre-strain of 2% or more was applied to the aluminum alloy sheet subjected to solution treatment and quenching treatment, and then 20-minute artificial aging treatment was performed thereon at 180° C.

When the 0.2% proof stress mentioned above is 250 MPa or more, it is possible to ensure a strength required of an aluminum sheet to be used for an automotive structural member. Note that the 0.2% proof stress is controlled with the contents in the aluminum alloy described above and, even in steps of a manufacturing method described later, the 0.2% proof stress can be controlled particularly with a heat history and a rolling reduction in each of the steps.

(Formability)

The formability can be evaluated based on an elongation at break shown in examples described later. Preferably, the elongation at break is 18% or more.

In the present embodiment, an aluminum alloy sheet having such a formability that the elongation at break is 18% or more is evaluated to be acceptable as an aluminum alloy sheet for automotive structural member. Meanwhile, when the aluminum alloy sheet has such a formability that the elongation at break is less than 18%, the aluminum alloy sheet is unacceptable as an aluminum alloy sheet for automotive structural member.

(Method for Manufacturing Aluminum Alloy Sheet for Automotive Structural Member)

Next, a description will be given below of a method for manufacturing the aluminum alloy sheet according to the present embodiment.

The method for manufacturing the aluminum alloy sheet for automotive structural member according to the present embodiment is a method for manufacturing an Al—Mg—Si-based aluminum alloy sheet including the steps of casting an aluminum alloy having the chemical composition described above; performing homogenization heat treatment; performing hot rolling; performing cold rolling; performing annealing; performing solution treatment; and performing quenching. A rolling ratio in the step of performing the cold rolling is controlled to be 20% or less, and a heat treatment temperature in the step of performing the annealing is set to be 275° C. or more.

In these manufacturing steps, the rolling ratio for the cold rolling and the temperature for the annealing treatment are adjusted appropriately in the numerical value ranges mentioned above to thus allow the earing ratio defined in the present embodiment to be obtained. A more detailed description will be given below of each of the steps.

<Melting/Casting>

First, in a melting/casting step, a molten aluminum alloy obtained by melting the aluminum alloy and adjusting a chemical composition thereof into a range of the 6xxx-series chemical composition described above is cast using an appropriately selected normal melting/casting method such as a continuous casting method or a semi-continuous casting method (DC casting method).

<Homogenization Heat Treatment>

Then, prior to the hot rolling, the homogenization heat treatment is performed on aluminum alloy ingots resulting from the casting described above. The homogenization heat treatment (soaking treatment) is important not only for texture homogenization (elimination of segregation in crystal grains in an ingot texture) as a normally intended purpose, but also for sufficient solid solution of Si and Mg. Conditions for the homogenization heat treatment are not particularly limited as long as the purpose is accomplished. The homogenization heat treatment may also be normal one-time or one-step homogenization heat treatment.

A homogenization heat treatment temperature is preferably selected appropriately within a range of 500° C. or more and 560° C. or less, and a homogenization (retention) time is preferably selected appropriately within a range of 1 hour or more. When the homogenization temperature is low, the segregation in the crystal grains cannot sufficiently be eliminated to serve as starting points of fracture and consequently degrade the crushability.

<Hot Rolling>

The hot rolling of each of the ingots subjected to the homogenization heat treatment includes a rough rolling step and a finish rolling step each for the ingot (slab) depending on a sheet thickness to which the ingot is to be rolled In the rough rolling step and the finish rolling step, a rolling machine of a reverse type, a tandem type, or the like is used appropriately.

«Rough Rolling Step»

In the hot rough rolling step, at such a rolling temperature that a hot rolling starting temperature exceeds a solidus temperature, burning occurs and consequently hot rolling may be difficult. When the hot rolling starting temperature is less than 350° C., a load during the hot rolling becomes excessively high in any soaking process material, and the hot rolling may be difficult. Accordingly, the hot rolling starting temperature is selected within a range of 350° C. to the solidus temperature, and the hot rolling is performed to provide a hot-rolled sheet having a sheet thickness of about 2 to 8 mm. Pre-cold-rolling annealing (rough annealing) of the hot-rolled sheet need not necessarily be performed, but may also be performed.

«Hot Finish Rolling»

After the hot rough rolling described above, the hot finish rolling for which an ending temperature is set in a range of 250 to 350° C. is performed. When the ending temperature for the hot finish rolling is less than 250° C. and excessively low, a rolling load may increase to possibly degrade productivity. Meanwhile, when the ending temperature for the hot finish rolling is increased to provide a re-crystalized texture without leaving much of a processed texture and when the temperature exceeds 350° C., coarse $Mg_2Si$ may be precipitated to increase the possibility of degrading the crushability.

Pre-cold-rolling annealing (rough annealing) of the hot-rolled sheet is not required, but may also be performed.

<Cold Rolling>

In the step of cold-rolling the hot-rolled sheet described above to an intended sheet thickness, when a cold rolling ratio is increased, it is impossible to allow the processed texture resulting from the hot rolling to remain and ensure a sufficient crushability. Specifically, when the rolling ratio of the cold rolling is set to 20% or less, a strain is scarcely introduced by the cold rolling, and it is possible to allow the processed texture resulting from the hot rolling to remain and set the earing ratio to −13.0% or less. As a result, the obtained aluminum alloy sheet has an improved crushability.

Therefore, the rolling ratio of the cold rolling is set to 20% or less, or preferably 10% or less.

<Annealing Treatment>

By performing the annealing treatment at a temperature of 275° C. or more, it is possible to preferentially grow nuclei of the Cube orientation remaining after the cold rolling without coarsening the nuclei and obtain the aluminum alloy sheet having the earing ratio of −13.0% or less. As a result, it is possible to obtain not only an excellent formability comparable to an existing formability, but also a high crushability. When the annealing temperature is lower than 275° C. and accordingly equal to or lower than a recrystallization temperature, recrystallization does not occur during the annealing, and the earing ratio exceeds −13.0%. As a result, the formability is excellent, but the crushability significantly deteriorates. Note that the annealing temperature is preferably 300° C. or more.

A temperature increase rate for the annealing treatment is preferably 1 to 500° C./h. When the temperature increase rate is lower than 1° C./h, a crystal grain diameter increases, and the crushability is likely to deteriorate. When the temperature increase rate is higher than 500° C./h, the number of nuclei of the Cube orientation is small and the area ratio of the Cube orientation decreases after the solution treatment, and consequently the crushability is likely to deteriorate.

<Solution Treatment and Quenching Treatment>

After the cold rolling, the solution treatment and the subsequent quenching treatment until a mom temperature is reached are sequentially performed. For the solution quenching treatment, a normal continuous heat treatment line may be used appropriately. However, to solid-solve each of elements such as Mg and Si in a sufficient amount, it is preferable to perform the solution treatment at a temperature of 500° C. or more and a melting point or less, and then set an average cooling speed until the room temperature is reached to 20° C./second or more. At a temperature lower than 500° C., solid re-solution of a compound such as an Mg—Si-based compound generated before the solution treatment is insufficient to reduce an amount of solid-solved Mg and an amount of solid-solved Si.

When an average cooling speed is less than 20° C./second, a Mg—Si-based precipitate is mainly generated during cooling to reduce the amount of solid-solved Mg and the amount of solid-solved Si and increase the possibility that the amounts of solid-solved Si and Mg cannot be ensured. To ensure the cooling speed, for the quenching treatment, an air cooling means such as a fan, a water cooling means such as a mist, a spray, or immersion, and conditions are selected to be used. After such solution treatment, pre-aging treatment may also be performed appropriately.

(Automotive Structural Member)

The present embodiment relates also to an automotive structural member using the aluminum alloy sheet described above. The aluminum alloy sheet according to the present embodiment has a raw material sheet which is excellent and well-balanced in strength, formability, and crushability. Therefore, when used as the automotive structural member, the aluminum alloy sheet has excellent safety.

EXAMPLES

The following will more specifically describe the present invention by using the examples. However, the present invention should not be limited by the following examples and can also be carried out with appropriate modifications within a scope adaptable to a gist described previously or later. All of these are included in a technical scope of the present invention.

6xxx-series aluminum alloy ingots having chemical compositions illustrated in Table 1 were prepared. Under various manufacturing conditions, aluminum alloy sheets for automotive structural member were manufactured, and earing ratios were measured.

For the obtained aluminum alloy sheets, the 0.2% proof stresses (MPa) before and after the artificial aging, the elongations at break (%), and VDA bending angles (°) after the artificial aging were measured to allow strengths, formabilities, and crushabilities of the aluminum alloy sheets to be evaluated.

<Production of Aluminum Alloy Sheets>

First, a detailed description will be given of manufacturing conditions. Aluminum alloys having the chemical compositions illustrated in Table 1 were melted/cast, and obtained ingots were subjected to homogenization heat treatment under such a condition that the ingots were held at a temperature of 560° C. for four hours. Then, hot rolling was performed so as to achieve an ending temperature of 250° C. to 350° C. Furthermore, cold rolling was performed at individual rolling ratios illustrated in Table 1 so as to achieve final sheet thicknesses of 2.0 mm and provide cold-rolled sheets.

The cold-rolled sheets were subjected to annealing treatment in which a temperature was increased at 30° C./h in an air furnace, the cold-rolled sheets were held at individual annealing temperatures illustrated in Table 1, and then the temperature was reduced at 40° C./h.

Thereafter, tempering treatment (T4 treatment) was performed using heat treatment equipment under the following common conditions. Specifically, solution treatment was performed by heating the sheets after being subjected to the annealing described above at an average heating speed of 5° C./second until a solution treatment temperature was reached and holding the sheets at a temperature of 525° C. for 28 seconds. Then, fan air cooling was performed at an average cooling speed of 20° C./second to cool the sheets to a room temperature. Immediately after the cooling, pre-aging treatment was performed under such a condition that the sheets were immediately held at 80° C. for five hours. After the pre-aging treatment, the sheets were gradually cooled (allowed to cool) to provide aluminum alloy sheets (T4 materials)

(Measurement of Earing Ratio)

From the obtained aluminum alloy sheets, specimen sheets were collected, and the earing ratios were measured by a method shown below. From the specimen sheets, disk-shaped specimens each having an outer diameter of 66 mm were punched out, and cupping was performed on the specimens using a punch having a diameter of 40 mm to produce drawn cups each having a cup diameter of 40 mm. Earing heights of the drawn cups were measured, and the earing ratios (0°-90° earing ratios) (%) were calculated based on Formula (1) shown above.

<Evaluation of Strength: Measurement of 0.2% Proof Stress>

From the individual specimen sheets described above, tensile test specimens (20 mm×80 mmGL×2.0 mm) according to JIS 13A were collected, and a tensile test was performed thereon at a room temperature under the following conditions to measure the 0.2% proof stresses. First, the two specimen sheets after being subjected to the pre-aging treatment were prepared. One of the specimen sheets not subjected to additional heat treatment was subjected to the measurement of the 0.2% proof stress. To the other of the specimen sheets, a pre-strain of 2% or more was applied, and the other specimen sheet was subjected to 20-minute artificial aging treatment at 180° C. and subsequently to the measurement of the 0.2% proof stress.

In the tensile test, a direction in which each of the specimens was pulled was set perpendicular to the rolling direction. A pulling speed was set to 5 mm/minute until the 0.2% proof stress was reached and then set to 20 mm/minute after the 0.2% proof stress was reached. The measurement operated five times, the five measurements were averaged, and the average was defined as the 0.2% proof stress. Note that when a result of the measurement of the 0.2% proof stress after the artificial aging treatment was 250 MPa or more, it was determined that the specimen had a stress sufficient for the automotive structural member, and the specimen was evaluated to be acceptable.

<Evaluation of Formability: Measurement of Elongation at Break>

From the individual specimen sheets described above, the tensile test specimens (20 mm×80 mmGL×2.0 mm) according to JIS 13A were collected, and a tensile test was performed thereon at a room temperature under the following conditions. In the tensile test, the specimens were each pulled at a speed of 5 mm/minute using a tensile tester, and elongations thereof when the specimens were cut (ruptured) were measured.

Each of the specimens was pulled in three directions which were a 0° direction, a 45° direction, and a 90° direction with respect to the rolling direction. The measurement was performed five times, and an average value of values calculated based on Formula (3) shown below was determined to be the elongation at break. In Formula (3) shown below, Lo represents a distance between gauge points before the tensile test, and L represents a distance between the gauge points at the time of rupture.

$$\text{Elongation at Break (\%)} = 100 \times (L - Lo)/Lo \quad (3)$$

Note that, when the elongation at break was 25% or more, the specimen was determined to have a sufficient formability for the automotive structural member and evaluated to be acceptable.

<Evaluation of Crushability: Measurement of VDA Bending Angle>

To each of the specimen sheets subjected to the preparatory treatment described above, a pre-strain of 2% or more was applied, and the specimen sheet was subjected to 20-minute artificial aging treatment at a temperature of 180° C. From the specimen sheet, a square specimen having the sheet thickness of 2.0 mm, the width b of 60 mm, and the length l of 60 mm was collected, and the crushability thereof was evaluated by the VDA bending test.

As the VDA bending test, a 3-point bending test based on VDA238-100 in which a bending line was parallel with the rolling direction was performed. A test speed until a load reached 30 N was set to 10 mm/minute, and a test speed thereafter was set to 20 mm/minute. Settings were made such that, when a maximum load decreased by 60 N due to formation of a crack or a sheet thickness reduction, bending was stopped.

In the bending test described above, measurement was performed on three specimens, and an average value of the measured values was used as the bending angle (°).

Note that, when the bending angle was 95° or more, the specimen was determined to have a sufficient crushability for the automotive structural member and evaluated to be acceptable.

Results of evaluating the strengths, the formabilities, and the crushabilities are shown in combination in Table 1. Note that, in Table 1, the specimens out of the scope of the present invention with regard to manufacturing conditions for the aluminum alloy sheets and material textures are shown by the underlined numerical values.

Likewise, in the results of evaluating the strengths, the formabilities, and the crushabilities, the specimens which could not be evaluated to be acceptable as materials for the automotive structural members are shown by the underlined numerical values.

TABLE 1

| Category | Contents of Components (Remainder Includes Al and Inevitable Impurities) Mg (mass %) | Si (mass %) | Cu (mass %) | Manufacturing Conditions for Al Alloy Sheets Rolling Ratio for Cold Rolling (%) | Annealing Temperature (° C.) | Material Texture Earing Ratio (%) | Evaluation Result Strength 0.2% Proof Stress Before Artificial Aging (MPa) | 0.2% Proof Stress After Artificial Aging (MPa) | Formability Elongation at Break (%) | Crushability VDA Bending Angle (°) |
|---|---|---|---|---|---|---|---|---|---|---|
| Example 1 | 0.8 | 0.7 | 0.7 | 10 | 300 | −13.0 | 129 | 254 | 18 | 132 |
| Example 2 | | | | 10 | 350 | −13.6 | 130 | 255 | 18 | 129 |
| Comparative Example 1 | 0.8 | 0.7 | 0.7 | 10 | 250 | x | 130 | 254 | 25 | 75 |
| Comparative Example 2 | | | | 29 | 250 | x | 125 | 257 | 24 | 53 |
| Comparative Example 3 | | | | 29 | 300 | −11.7 | 127 | 254 | 22 | 58 |
| Comparative Example 4 | | | | 29 | 350 | −11.6 | 128 | 254 | 22 | 57 |
| Comparative Example 5 | | | | 47 | 250 | −8.8 | 131 | 262 | 26 | 50 |
| Comparative Example 6 | | | | 47 | 300 | −12.4 | 135 | 256 | 22 | 53 |
| Comparative Example 7 | | | | 47 | 350 | −12.5 | 135 | 259 | 23 | 52 |

In Table 1 shown above, "x" in the result of evaluating the earing ratios indicates that a crack was formed in the specimen during an earing ratio test (during drawing forming), and the earing ratio could not be measured.

As is obvious from Table 1, in each of Examples 1 and 2, the aluminum alloy had a chemical composition within the scope of the present invention and was manufactured under the conditions defined by the present invention.

Specifically, in each of Examples 1 and 2, the aluminum alloy had a chemical composition in mass % such that Mg: 0.4% or more and 1.0% or less, Si: 0.6% or more and 1.2% or less, and Cu: 0.6% or more and 1.3% or less and had an earing ratio of −13.0% or less. As a result, an aluminum alloy sheet which was excellent and well-balanced in strength, formability, and crushability could be obtained.

By contrast, in each of Comparative Examples 1 to 7, the rolling ratio for the cold rolling or the annealing temperature is out of the scope of the present invention. As a result, the earing ratio was out of the scope of the present invention to result in a poor crushability.

Specifically, in each of Comparative Examples 1, 2, and 5, the annealing temperature was lower than the scope defined in the present invention and, in each of Comparative Examples 2 to 7, the rolling ratio during the cold rolling was higher than the scope defined in the present invention. Accordingly, in either case, the earing ratio was out of the scope of the present invention to result in a degraded crushability.

From the results of Examples and Comparative Examples described hitherto, it will be understood that aluminum alloy sheets which satisfy all the requirements placed on chemical compositions and textures defined in the present invention are appropriate for the automotive structural members.

INDUSTRIAL APPLICABILITY

According to the present invention, it is possible to provide a 6xxx-series aluminum alloy sheet to be manufactured by normal rolling not only with an excellent crushability and an excellent strength which are specific to the use purpose as the automotive structural member, but also with a formability. This allows the 6xxx-series aluminum alloy sheet to be increasingly used for the automotive structural members.

What is claimed is:

1. An aluminum alloy sheet for automotive structural member which is an Al—Mg—Si-based aluminum alloy sheet containing, in mass %, Mg: 0.4% or more and 1.0% or less, Si: 0.6% or more and 1.2% or less, and Cu: 0.7% or more and 1.3% or less with the remainder being Al and inevitable impurities, wherein an earing ratio is −13.0% or less and a VDA bending ratio is 95° or more.

2. The aluminum alloy sheet for automotive structural member according to claim 1, wherein the content of Mg in mass % is 0.4% or more and 0.6% or less.

3. The aluminum alloy sheet for automotive structural member according to claim 2, wherein the content of Si in mass % is 0.6% or more and 0.8% or less.

4. The aluminum alloy sheet for automotive structural member according to claim 2, further containing, in mass %, at least one selected from the group consisting of Mn: 1.0% or less, Fe: 0.5% or less, Cr: 0.3% or less, Zr: 0.2% or less, V: 0.2% or less, Ti: 0.1% or less, Zn: 0.5% or less, Ag: 0.1% or less, and Sn: 0.15% or less.

5. The aluminum alloy sheet for automotive structural member according to claim 3, further containing, in mass %, at least one selected from the group consisting of Mn: 1.0% or less, Fe: 0.5% or less, Cr: 0.3% or less, Zr: 0.2% or less, V: 0.2% or less, Ti: 0.1% or less, Zn: 0.5% or less, Ag: 0.1% or less, and Sn: 0.15% or less.

6. The aluminum alloy sheet for automotive structural member according to claim 1, wherein the content of Si in mass % is 0.6% or more and 0.8% or less.

7. The aluminum alloy sheet for automotive structural member according to claim 6, further containing, in mass %, at least one selected from the group consisting of Mn: 1.0% or less, Fe: 0.5% or less, Cr: 0.3% or less, Zr: 0.2% or less, V: 0.2% or less; Ti: 0.1% or less, Zn: 0.5% or less, Ag: 0.1% or less, and Sn: 0.15% or less.

8. The aluminum alloy sheet for automotive structural member according to claim 1, further containing, in mass %, at least one selected from the group consisting of Mn: 1.0% or less, Fe: 0.5% or less, Cr: 0.3% or less, Zr: 0.2% or less, V: 0.2% or less, Ti: 0.1% or less, Zn: 0.5% or less, Ag: 0.1% or less, and Sn: 0.15% or less.

9. The aluminum alloy sheet for automotive structural member according to claim 1, wherein the aluminum alloy sheet for automotive structural member has such a bake hard property that, after 20-minute artificial aging treatment is performed at 180° C., a 0.2% proof stress is 250 MPa or more.

* * * * *